US007448620B2

(12) United States Patent
Ha

(10) Patent No.: US 7,448,620 B2
(45) Date of Patent: Nov. 11, 2008

(54) SCANNING APPARATUS AND METHOD OF PREVENTING DAMAGE OF GEARS OF THE SAME

(75) Inventor: Dong-woo Ha, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 305 days.

(21) Appl. No.: 10/998,723

(22) Filed: Nov. 30, 2004

(65) Prior Publication Data

US 2005/0184454 A1 Aug. 25, 2005

(30) Foreign Application Priority Data

Dec. 1, 2003 (KR) ..... 10-2003-0086506

(51) Int. Cl.
*B65H 7/02* (2006.01)

(52) U.S. Cl. ..... 271/258.01; 271/265.01

(58) Field of Classification Search ..... 271/265.01, 271/258.01, 258.02, 270; 399/361
See application file for complete search history.

(56) References Cited

U.S. PATENT DOCUMENTS

| | | | | |
|---|---|---|---|---|
| 4,936,695 | A * | 6/1990 | Ishii | 400/605 |
| 5,141,346 | A * | 8/1992 | Nakagawa | 400/605 |
| 5,150,630 | A * | 9/1992 | Kida et al. | 74/354 |
| 5,206,737 | A * | 4/1993 | Sugiyama | 358/296 |
| 5,213,426 | A * | 5/1993 | Ewing | 400/624 |
| 5,225,917 | A * | 7/1993 | Osako | 358/498 |
| 5,526,141 | A * | 6/1996 | Ogura et al. | 358/496 |
| 5,713,059 | A * | 1/1998 | Ishikawa | 399/18 |
| 5,727,890 | A * | 3/1998 | Stodder et al. | 400/624 |
| 5,740,696 | A * | 4/1998 | Jean et al. | 74/354 |

(Continued)

FOREIGN PATENT DOCUMENTS

| | | |
|---|---|---|
| JP | 06-138721 | 5/1994 |
| JP | 08-030166 | 2/1996 |
| JP | 11-305587 | 11/1999 |
| KR | 1994-27773 | 10/1994 |
| KR | 1996-15763 | 11/1996 |
| KR | 1999-00268776 | 7/1999 |

OTHER PUBLICATIONS

Korean Office Action issued in corresponding Korean Application No. 2003-86506.

*Primary Examiner*—Patrick H Mackey
*Assistant Examiner*—Gerald W McClain
(74) *Attorney, Agent, or Firm*—Stanzione & Kim, LLP

(57) ABSTRACT

A scanning apparatus and a method of preventing damage of gear may include a driving roller to transfer a document sheet while being in contact with a scanning glass of a reading unit and configured to be spaced-apart from the scanning glass so that a jammed sheet can be removed, a driving gear joined to the driving roller, a power transmitting gear to be selectively engaged with the driving gear so as to supply a rotational force of a driving motor to the driving roller, a first sensor installed at a front side of the driving roller to detect a document sheet, a controlling portion to control a scanning process, wherein the controlling portion controls the power transmitting portion to be spaced-apart from the driving gear when the first sensor cannot detect the document sheet.

10 Claims, 8 Drawing Sheets

U.S. PATENT DOCUMENTS 5,854,696 A * 12/1998 Yun ..... 358/498
6,722,648 B2 * 4/2004 Tsusaka et al. ..... 271/65
6,942,215 B2 * 9/2005 Kang et al. ..... 271/265.01
7,099,619 B2 * 8/2006 Choi ..... 399/367
7,123,386 B2 * 10/2006 Tanaka et al. ..... 358/474
2002/0190460 A1 * 12/2002 Gaarder et al. ..... 271/117
2003/0063337 A1 * 4/2003 Shirai et al. ..... 358/498
2003/0234965 A1 * 12/2003 Yang ..... 358/498
2004/0124575 A1 * 7/2004 Lee et al. ..... 271/10.01
2006/0269350 A1 * 11/2006 Koba et al. ..... 400/691

* cited by examiner

SCANNING APPARATUS AND METHOD OF PREVENTING DAMAGE OF GEARS OF THE SAME

CROSS-REFERENCE TO RELATED APPLICATIONS

This application claims the benefit of Korean Patent Application No. 2003-86506 filed with the Korea Industrial Property Office on Dec. 1, 2003, the disclosure of which is incorporated herein by reference.

BACKGROUND OF THE INVENTION

1. Field of the Invention

The present general inventive concept relates to a scanning apparatus to read image information from a document sheet and a method of preventing damage of gears of the scanning apparatus.

2. Description of the Related Art

In general, a scanning apparatus is an apparatus for reading literal information and/or image information from a document sheet on which the literal information and/or the image information is recorded, and is applicable to a transmitting portion of a facsimile or a combined apparatus for printing, a scanning portion of a scanner and a copier, etc.

The scanning apparatus includes a driving roller for transferring the document sheet at a predetermined speed, and a reading unit for reading the image information from the document sheet. Usually, the driving roller is in contact with a scan glass of the reading unit at a predetermined contacting pressure. A driving gear is joined to the driving roller, and a driving motor is connected to the driving gear via a series of gears.

When a sheet jam occurs during transferring the document sheet, the document sheet must be removed from a sheet transfer path. To this end, it is preferable that the driving roller is spaced from the scan glass of the reading unit, and the driving gear is separated from the series of gears. After the jammed sheet is removed, the driving roller is controlled to be in contact with the scan glass, and the driving gear is again connected to the series of gears. When the driving gear is again connected to the series of gears, the driving gear and/or the series of gears may be damaged as the teeth of the driving gear and the series of gears collide with each other.

Since the reading unit reads information at a resolution of several hundred and higher DPI (dot per inch), the document sheet must be very precisely transferred. As described above, when the driving gear or the series of gears are damaged, the precise transference of the document sheet deteriorates.

SUMMARY OF THE INVENTION

To solve the above and/or other problems, it is an aspect of the present general inventive concept to provide a scanning apparatus in which gears can be prevented from being damaged while a driving roller comes in contact with a reading unit and is spaced-apart from the reading unit, and a method of preventing damage of gears of the scanning apparatus.

Additional aspects and advantages of the present general inventive concept will be set forth in part in the description which follows and, in part, will be obvious from the description, or may be learned by practice of the general inventive concept.

The above and/or other aspect of the present general inventive concept may be achieved by providing a scanning apparatus including a driving roller to transfer a document sheet while being in contact with a scanning glass of a reading unit and being configured to be spaced-apart from the scanning glass so that a jammed sheet can be removed, a driving gear joined to the driving roller, a power transmitting gear to be selectively engaged with the driving gear so as to supply a rotational force of a driving motor to the driving roller, a first sensor installed at a front side of the driving roller to detect the document sheet, and a controlling portion to control a process of scanning, wherein the controlling portion controls the power transmitting gear to be spaced-apart from the driving gear when the first sensor cannot detect the document sheet.

In an aspect of the present general inventive concept, the scanning apparatus may further include an ADF (automatic document feed) roller to separate the document sheet from document sheets stacked on a document sheet tray one by one and to transfer the document sheet to a predetermined path, and a second sensor to detect the document sheets stacked on the document sheet tray. In this case, it is possible that when the first sensor and the second sensor cannot detect the document sheets, the controlling portion causes the power transmitting gear to be spaced from the driving gear.

The above and/or other aspect of the present general inventive concept may also be achieved by providing a method of preventing damage of gears of a scanning apparatus including a driving roller which is selectively in contact with or spaced-apart from a scanning glass of a reading unit, and a power transmitting gear which is installed at a swing arm to pivot according to a rotational direction of a driving motor and is selectively engaged with a driving gear joined to the driving roller so as to transmit a rotational force of the driving motor to the driving gear, the method comprising controlling the driving gear to rotate when a document sheet is not detected by a first sensor installed at a front side of the driving roller, and controlling the power transmitting gear to be spaced-apart from the driving gear according to a rotation of the driving motor to prevent the driving gear and the power transmitting gear from colliding with each other and being damaged when the driving roller comes in contact with the scanning glass.

In an aspect of the present general inventive concept, it is possible that when no document sheet is detected by the first sensor and a second sensor to detect document sheets to be drawn into an ADF roller, the power transmitting gear is caused to be spaced-apart from the driving gear.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
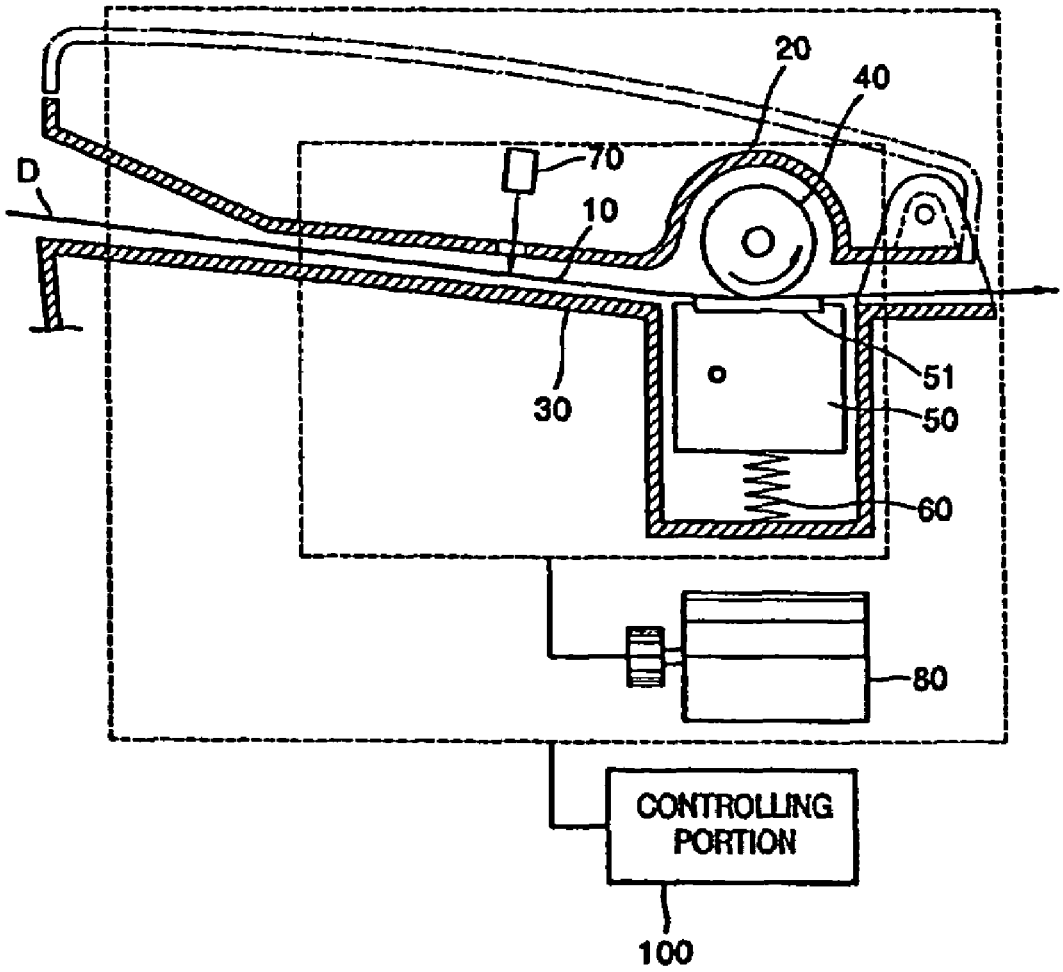
FIGS. 1 and 2 are section views illustrating a scanning apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
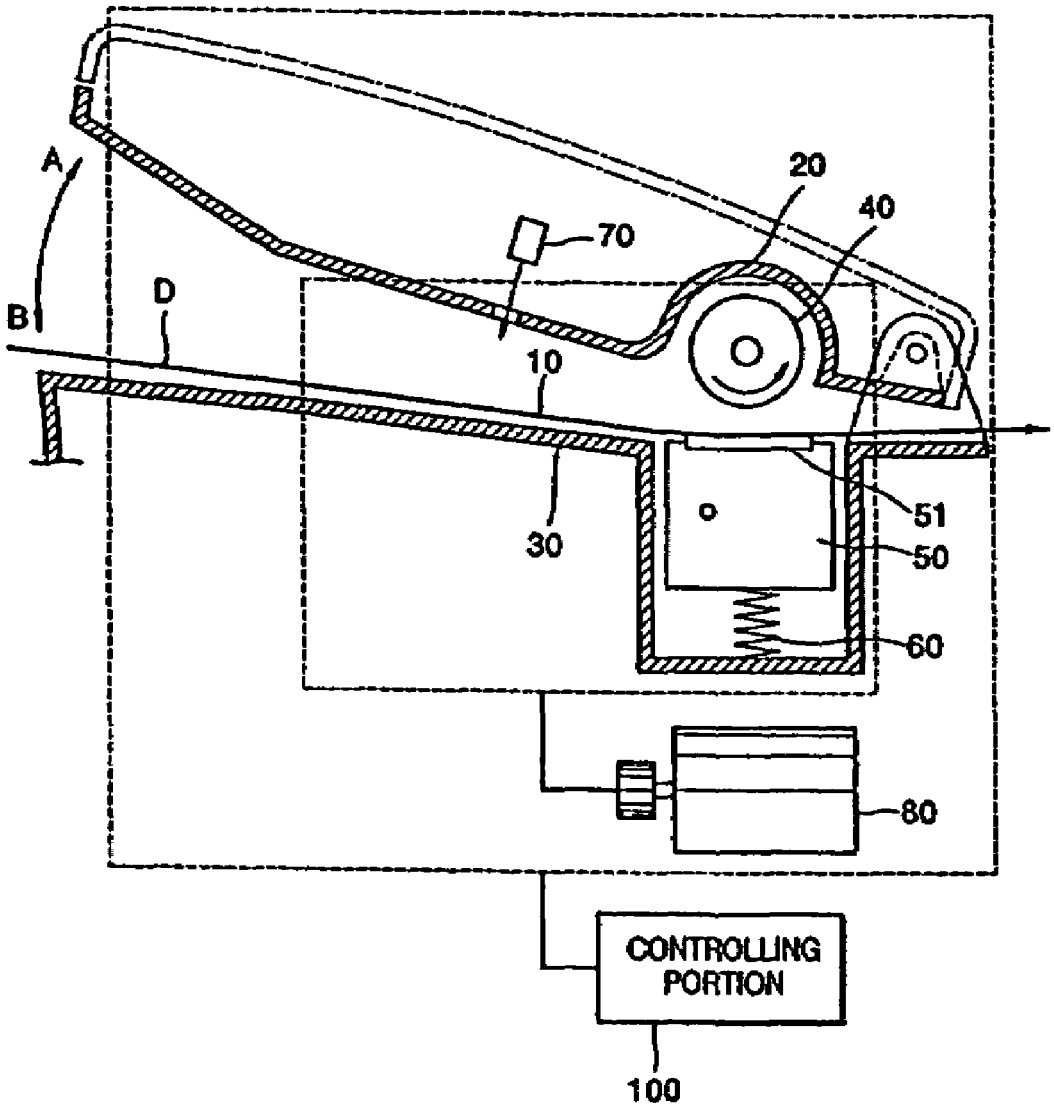

FIGS. 1 and 2 are section views illustrating a scanning apparatus according to an embodiment of the present general inventive concept.

Referring to FIGS. 1 and 2, an upper frame 20 and a lower frame 30 can be disposed to face each other to form a document sheet transfer path 10. A driving roller 40 can be installed at the upper frame 20. Reference numeral 50 denotes a CIS (contact image sensor) shown as an example of a reading unit to read image information from a document sheet D. The CIS 50 can read the image information by illuminating the document sheet D with light and detecting the intensity of the reflected light therefrom. A CCD (charge coupled device) may be employed instead of the CIS 50. The driving roller 40 can be in contact with a scan glass 51 of the CIS 50. Reference numeral 60 denotes an elastic member to elastically bias the CIS 50 toward the driving roller 40. The document sheet D can be transferred through a space between the driving roller 40 and the scan glass 51. The driving roller 40 can be manufactured to generally have a white color so as to adjust a white level, and is sometimes called a white roller. Reference numeral 70 denotes a first sensor to detect the document sheet D transferred along the document sheet transfer path 10. The first sensor 70 can be installed at the upper frame 20. Reference numeral 80 denotes a driving motor to rotate the driving roller 40, and reference numeral 100 is a controlling portion to control a scanning process of the scanning apparatus.

When the document sheet D is inserted into the document sheet transfer path 10, the first sensor 70 can detect the document sheet D. When the document sheet D starts to be transferred by the driving roller 40, the CIS 50 can start to read the image information from the document sheet D.

When a sheet jam occurs, it is necessary to open the document sheet transfer path 10 so as to remove a jammed document sheet D from the document sheet transfer path 10. To this end, the upper frame 20 can be installed to pivot with respect to the lower frame 30. When the upper frame 20 pivots in a direction of an arrow A and is opened as shown in FIG. 2, the document sheet transfer path 10 is opened, and the driving roller 40 is spaced-apart from the scan glass 51 of the CIS 50. In this state, the jammed document sheet D can be removed from the document sheet transfer path 10. When the upper frame 20 pivots in a direction of an arrow B to be closed, the document sheet transfer path 10 can be formed, and the driving roller 40 can come in contact with the scan glass 51.

Figure 3:
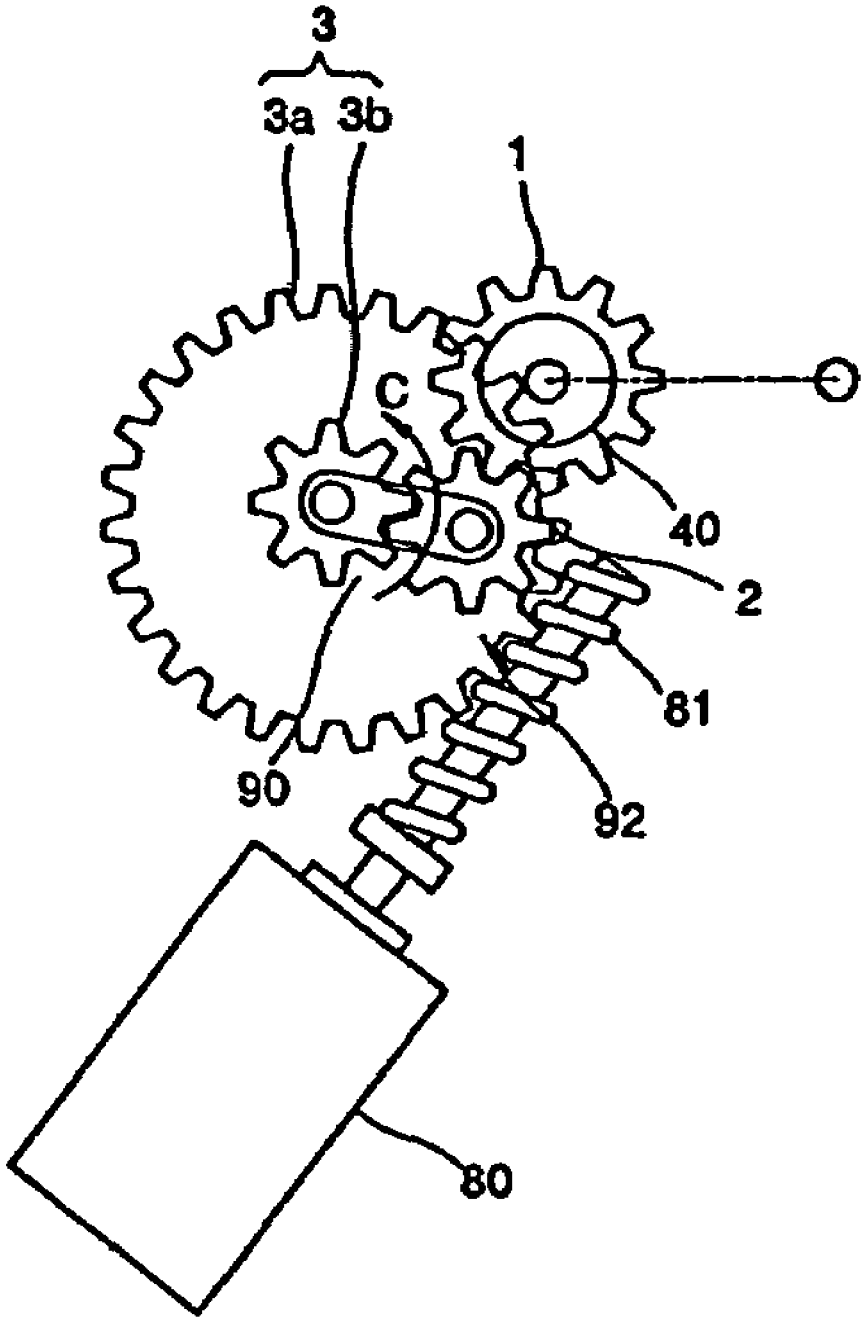
FIGS. 3 and 4 are structural diagrams illustrating a connection relationship between a driving motor and a driving roller of the scanning apparatus of FIGS. 1 and 2.

FIG. 3 is a structural diagram illustrating a connection relationship between the driving motor 80 and the driving roller 40.

Referring to FIGS. 1-3, a driving gear 1 can be joined to the driving roller 40. The driving gear 1 can be connected to the driving motor 80 via a power transmitting gear 2. The driving gear 1 can become separated from the power transmitting gear 2 when the upper frame 20 pivots in the direction of the arrow A and is opened as shown in FIG. 2, and the driving gear 1 can become engaged with the power transmitting gear 2 when the upper frame 20 pivots in the direction of the arrow B, and is closed. At this time, if a position of the power transmitting gear 2 is fixed, the teeth of the driving gear 1 and the power transmitting gear 2 may be damaged while the driving gear 1 and the power transmitting gear 2 collide with each other.

In the scanning apparatus according to this embodiment, the above-mentioned damage of gears can be prevented, and the power transmitting gear 2 can be separated from the driving gear 1.

Referring to FIG. 3, a worm gear 81 can be installed at a rotating shaft of the driving motor 80. A gear unit 3 may include a first gear portion 3*a* and a second gear portion 3*b*. A swing arm 90 can be installed at a rotating shaft of the gear unit 3. The power transmitting gear 2 is installed at the swing arm 90, and the power transmitting gear 2 can be engaged with the second gear portion 3*b*. When the driving motor 80 rotates in a forward or reverse direction, the swing arm 90 can pivot on the rotating shaft of the gear 3.

In the scanning apparatus according to this embodiment, it is checked whether or not the document sheet D is detected. When the document sheet D is not detected by the first sensor 70, the power transmitting gear 2 can be separated from the driving gear 1. This is based on facts that the document sheet D is not detected by the first sensor 70 when the upper frame 20 is opened, as shown in FIG. 2, due to a reason for removing a jammed document sheet or other reasons, and the driving roller 40 does not need to be rotated when the document sheet D is not detected by the first sensor 70.

Hereinafter, an operation and effect of the scanning apparatus according to this embodiment, and a method of preventing damage of gears will be described with reference to FIGS. 1 through 4.

Figure 4:
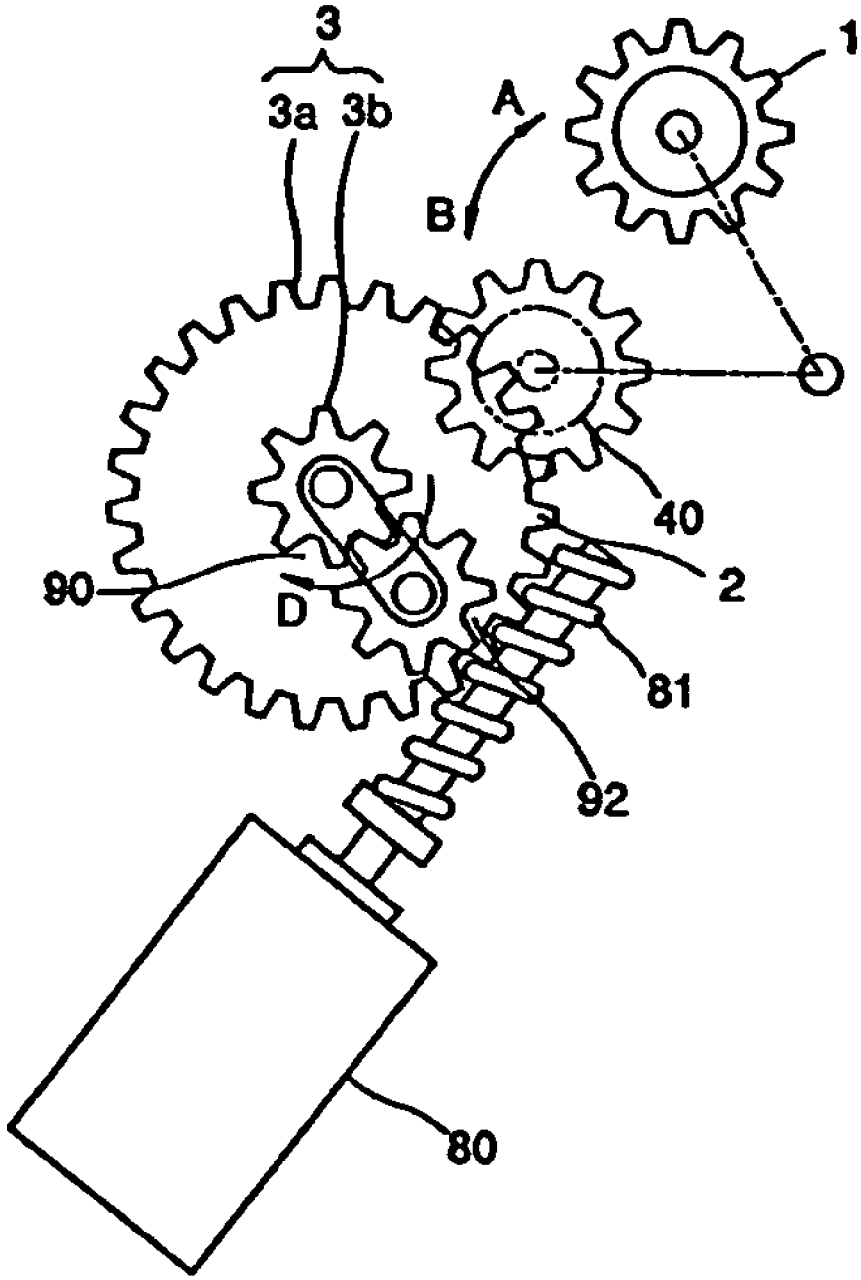

When the document sheet D is inserted into the document sheet transfer path 10, and the first sensor 70 can detect the document sheet D, the controlling portion 100 can control the driving motor 80 to rotate in the forward direction. Then, the swing arm 90 can pivot in a direction of an arrow C as shown in FIG. 3, and as the power transmitting gear 2 engages the driving gear 1 to control the driving roller 40 to rotate, the document sheet D can be transferred along the document sheet transfer path 10. After the document sheet D is detected by the first sensor 70, and the document sheet D starts to be transferred, the controlling portion 100 can determine whether a rear end of the document sheet D is detected by the first sensor 70. The first sensor 70 is considered to be, for example, in an "ON" state when the document sheet D is detected by the first sensor 70, and when the first sensor 70 returns to an "OFF" state, it can be recognized that the rear end of the document sheet D is detected. When the first sensor 70 does not return to the "OFF" state after a predetermined time has passed, it can be considered that a sheet jam occurs in the document sheet transfer path 10. In this case, the upper frame 20 is opened so that the driving roller 40 can be spaced from the scan glass 51, and the document sheet transfer path 10 can be opened. At this time, since the first sensor 70 is spaced-apart from the document sheet D and cannot detect the document sheet D, the first sensor 70 returns to the "OFF" state. When the first sensor 70 can become in the "OFF" state, the controlling portion 100 can control the driving motor 80 to rotate in the reverse direction. Then, the swing arm 90 can pivot in a direction of an arrow D as shown in FIG. 4, and the power transmitting gear 2 can be displaced from a place capable of being engaged with driving gear 1.

When the upper frame 20 is closed after the jammed document sheet D is removed from the document sheet transfer path 10, the driving roller 40 can become in contact with the scan glass 51, and the driving gear 1 can be positioned to be able to be engaged with the power transmitting gear 2. At this time, since the power transmitting gear 2 is spaced from the position to engage with the driving gear 1, the driving gear 1 and the power transmitting gear 2 do not collide with each other. Therefore, the driving gear 1 and the power transmitting gear 2 can be prevented from being damaged. When a new document sheet D is inserted into the document sheet transfer path 10, and the first sensor 70 returns to the "ON" state, the controlling portion 100 can control the driving motor 80 to rotate in the forward direction so that the power transmitting gear 2 can be engaged with the driving gear 1.

Since the document sheet D is not detected by the first sensor 70 in a state in which the first sensor 70 waits for the document sheet D to be inserted into the document sheet transfer path 10, the power transmitting gear 2 can be maintained at another position spaced from the position to be able to engage with the driving gear 1.

Figure 5:
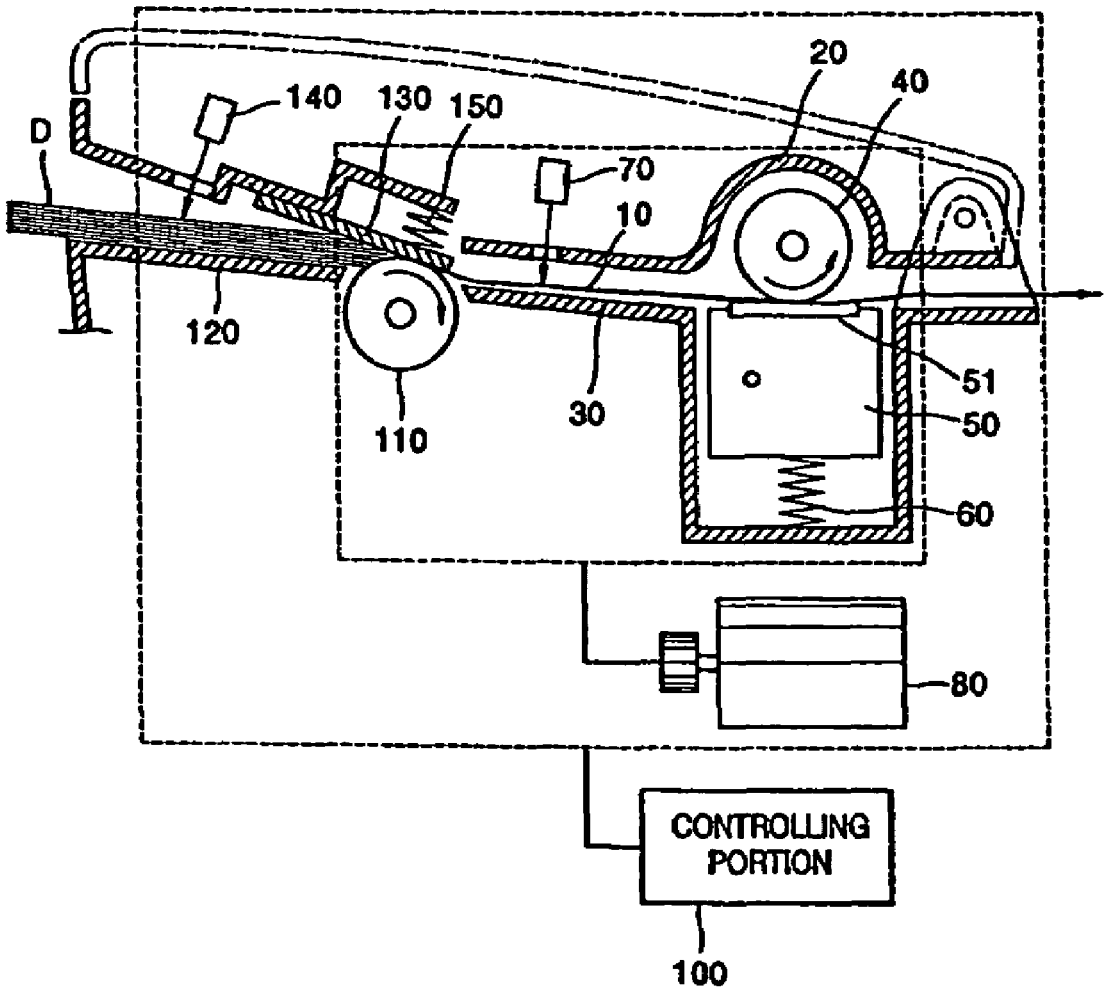
FIGS. 5 and 6 are section views illustrating a scanning apparatus according to another embodiment of the present general inventive concept.
Figure 6:
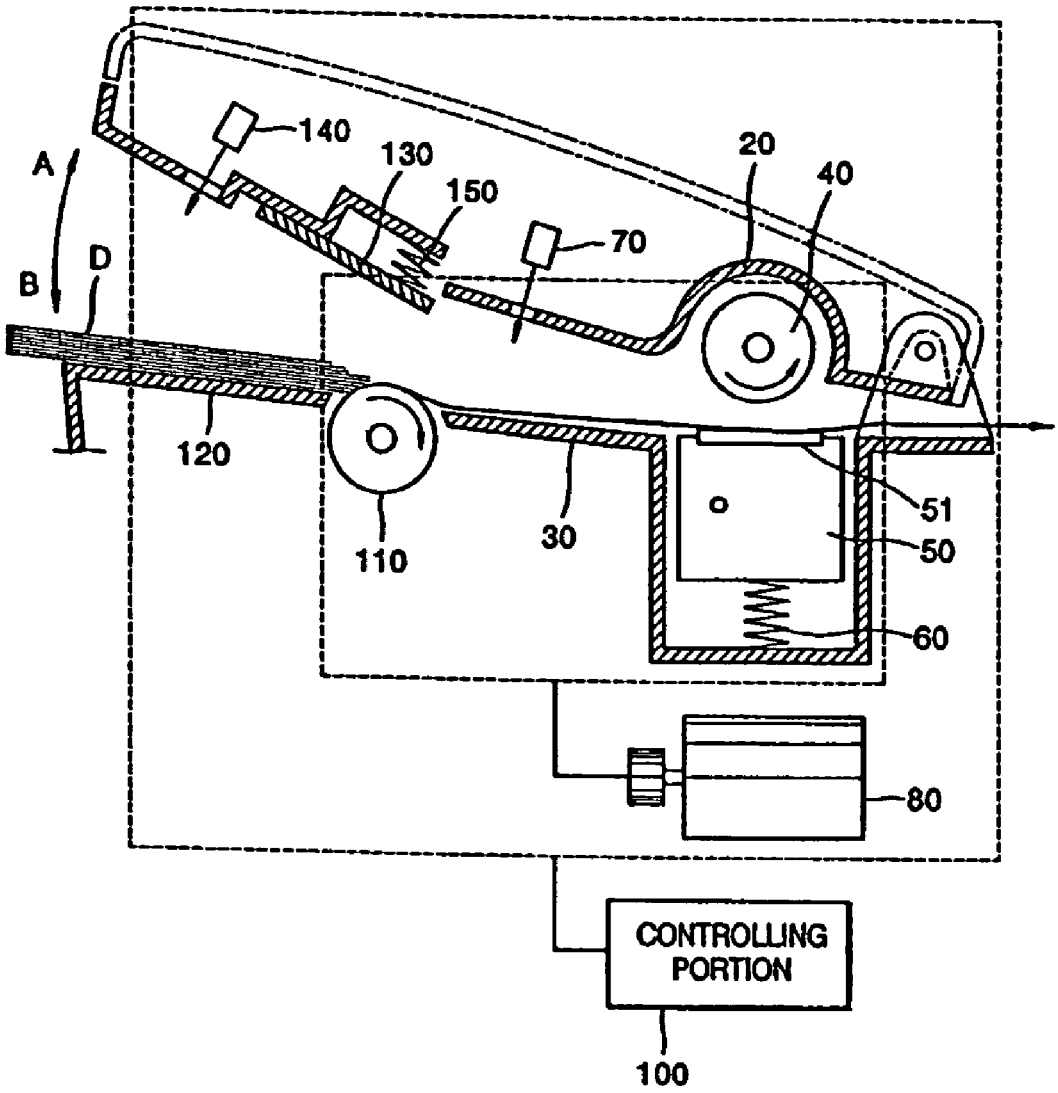

FIGS. 5 and 6 are section views illustrating a scanning apparatus according to another embodiment of the present general inventive concept. In the following descriptions, the same reference numerals denote similar members having substantially similar functions of FIGS. 1 through 4, and repeating descriptions thereof are omitted.

Referring to FIGS. 5 and 6, the scanning apparatus of this embodiment may further include an automatic document feed roller (an ADF roller) 110 to draw document sheets stacked on a document sheet tray 120 one by one, and to transfer the document sheets one by one to a document sheet transfer path 10. A separating member 130 can be in contact with an outer circumferential surface of the ADF roller 110 in a pressed manner. A document sheet D is separated from a stack of the document sheets D by differences of frictional coefficients between the ADF roller 110 and the document sheet D, the document sheet D and another separating member 130, and the document sheet D and the document sheet D. That is, when the frictional coefficients between the ADF roller 110 and the document sheet D, the document sheet D and the separating member 130, and another document sheet D and the document sheet D are $\mu_1$, $\mu_2$, and $\mu_3$, respectively, they have a relationship of $\mu_1>\mu_2>\mu_3$. Therefore, even though a plurality of document sheets D are introduced between the ADF roller 110 and the separating member 130, only a lowermost document sheet D being in contact with the ADF roller 110 can be separated from the plurality of document sheets D and can be transferred to the document sheet transfer path 10. In this embodiment, the separating member 130 is installed at an upper frame 20. Reference numeral 150 denotes an elastic member to control the separating member 130 to be in contact with the outer circumferential surface of the ADF roller 110 in the pressed manner. Reference numeral 140 denotes a second sensor for detecting whether or not document sheets D are stacked on the document sheet tray 120. The second sensor 140 can be installed at the upper frame 20.

Figure 7:
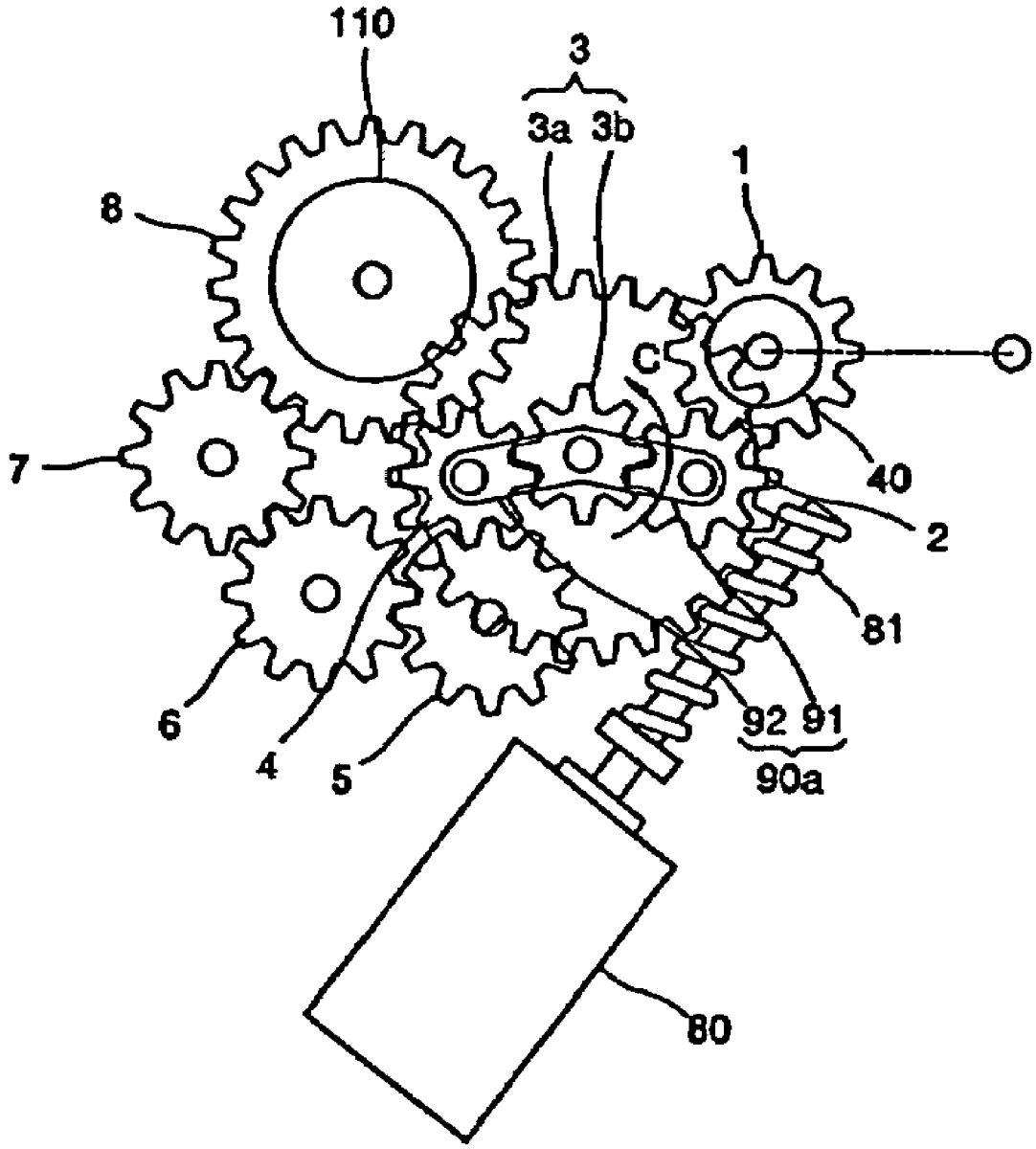
FIGS. 7 and 8 are structural diagrams illustrating a connection relationship among a driving motor, a driving roller, and an ADF (automatic document feed) roller of the scanning apparatus of FIGS. 5 and 6.
Figure 8:
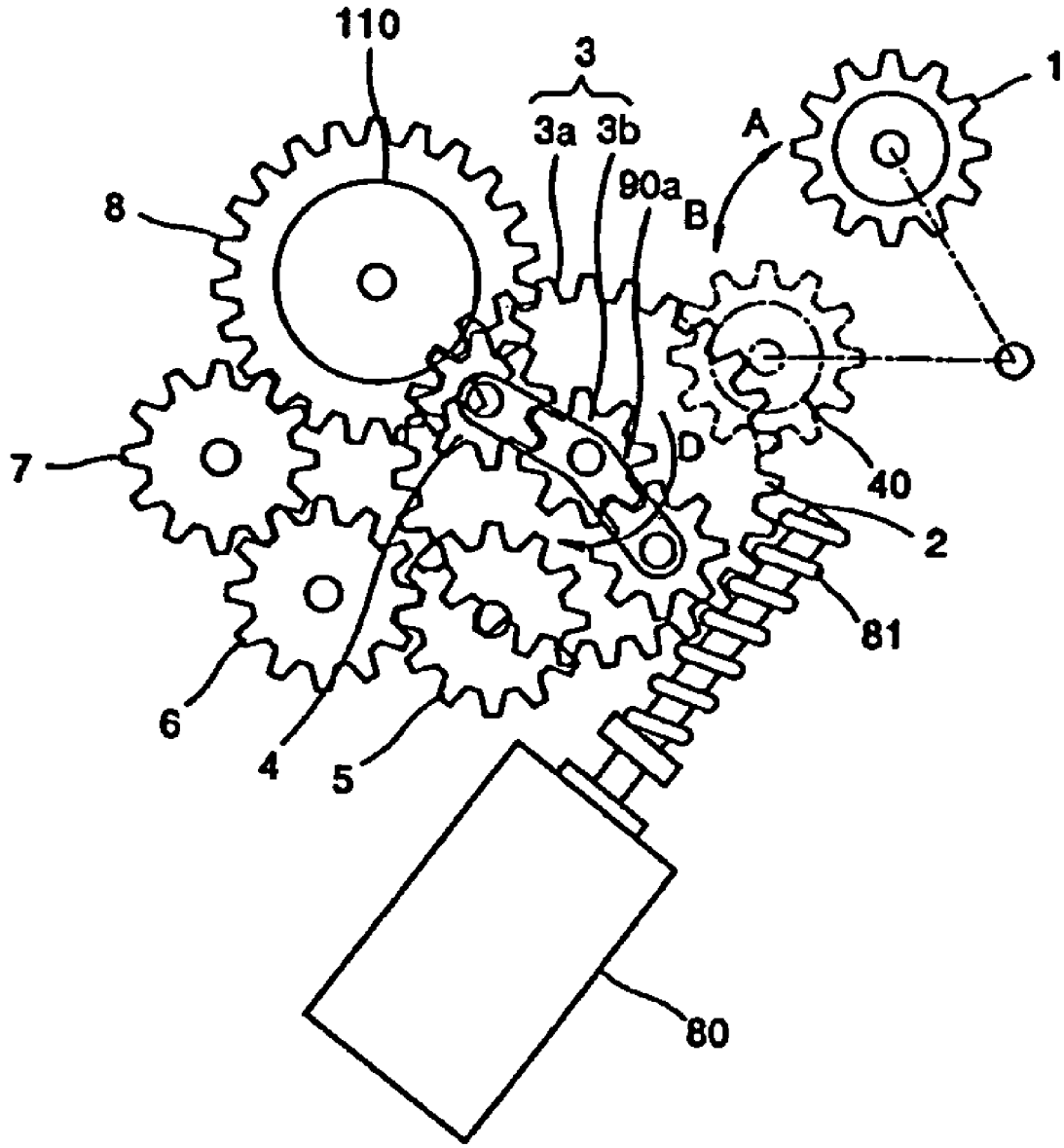

FIGS. 7 and 8 are structural diagrams illustrating a connection relationship among a driving motor 80, a driving roller 40, and the ADF roller 110.

Referring to FIGS. 7 and 8, a swing arm 90*a* can be installed at a rotating shaft of a gear unit 3. The swing arm 90*a* may have first and second arms 91 and 92. A power transmitting gear 2 can be installed at the first arm 91. A gear 4 to drive the ADF roller 110 can be installed at the second arm 92. The gear 4 and the power transmitting gear 2 can be connected to a second gear portion 3*b*. A gear 8 joined to the ADF roller 110 can be connected to the gear 4 using gears 5, 6, and 7.

Now, a scanning apparatus and a method of preventing damage of gears according to an aspect of the present general inventive concept will be described with reference to FIGS. 5 through 8.

In a state in which the document sheets D are not stacked on the document sheet tray 120, the second sensor 140 can be, for example, in an "OFF" state, and a first sensor 70 is also in the "OFF" state since there is no document sheet D in the document sheet transfer path 10. In this state, the controlling portion 100 can control the driving motor 80 to rotate in a reverse direction, and, therefore, the swing arm 90*a* can pivot in the direction of the arrow D, as shown in FIG. 8. Then, the power transmitting gear 2 is spaced from a driving gear 1. Therefore, in this state, even though the upper frame 20 is opened and closed, the driving gear 1 and the power transmitting gear do not collide with each other.

When the document sheets D are stacked on the document sheet tray 120, the second sensor 140 can detect the document sheets D and can become in an "ON" state. When a scanning start order is inputted to the controlling portion 100, the controlling portion 100 can control the driving motor 80 to rotate in a forward direction. Then, as the swing arm 90*a* pivots in the direction of the arrow C as shown in FIG. 7, the gear 4 can engage with the gear 5, and the power transmitting gear 2 can engage the driving gear 1. Only one document sheet D can be separated from the plurality of document sheets D stacked on the document sheet tray 120 by the ADF roller 120 and the separating member 130, and can be fed to the document sheet transfer path 10. When the first sensor 70 detects the document sheet D, the first sensor 70 can return to, for example, the "ON" state. The driving roller 40 can transfer the document sheet D along the document sheet transfer path 10 while being in contact with a scan glass 51, and a CIS 50 can read the image information from the document sheet D.

The controlling portion 100 can determine whether the rear end of the document sheet D is detected by the first sensor 70. When the first sensor 70 does not return to the "OFF" state after a predetermined time has passed, it can be determined that a sheet jam occurs in the document sheet transfer path 10. In this case, the upper frame 20 can be opened so that the driving roller 40 can be spaced from the scan glass 51, and the document sheet transfer path 10 can be opened. At this time, since the first sensor 70 is spaced from the document sheet D, and cannot detect the document sheet D the first sensor 70 can return to the "OFF" state. Since the second sensor 140 is also spaced from the document sheets D, and cannot detect the document sheets D, the second sensor 140 can become in the "OFF" state. Then, the controlling portion 100 can control the driving motor 80 to rotate in the reverse direction so that the power transmitting gear 2 can be spaced from a position to engage with the driving gear 1 (FIG. 8). At this time, the gear 4 can also be spaced from the gear 5. When the upper frame 20 is closed after the jammed document sheet D is removed from the document sheet transfer path 10, the driving roller 40 can become in contact with the scan glass 51, and the driving gear 1 is positioned to be able to be engaged with the power transmitting gear 2. At this time, since the power transmitting gear 2 is spaced from the position to engage with the driving gear 1, the driving gear 1 and the power transmitting gear 2 do not collide with each other. Therefore, the driving gear 1 and the power transmitting gear 2 can be prevented from being damaged.

Thus, in the case that the scanning apparatus employs the first sensor 70 and the second sensor 140, when both the first sensor 70 and the second sensor 140 are in the "OFF" state, that is, the first sensor 70 and the second sensor 140 cannot detect the document sheets D, the controlling portion 100 can control the power transmitting gear 2 to be spaced-apart from the position to be able to engage the driving gear 1. Since the state in which both the first sensor 70 and the second sensor 140 can be in the "OFF" state includes only two states, that is, a first state in which there is no document sheet D on the document sheet tray 120 and in the document sheet transfer path 10, and a second state in which the upper frame 20 is opened, there is no functional problem even though the power transmitting gear 2 is spaced from the driving gear 1 in the above two states.

As described above, with the scanning apparatus and the method of preventing damage of gears according to the present general inventive concept, the damage of gears can be prevented while the document sheet transfer path is opened and again closed so that a jammed sheet can be removed from the document sheet transfer path, Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A scanning apparatus, comprising:

a lower frame a reading unit disposed in the lower frame to read a document;

a driving roller disposed in the upper frame to form a path with the reading unit, to transfer the document along the path so that the reading unit reads the document, and to move between a first position close to the reading unit and a second position away from the reading unit;

an upper frame installed to pivot with respect to the lower frame to form a transfer path of the document sheet along the reading unit;

a driving gear jointed to the driving roller;

a driving motor; and a power transmitting gear installed at the lower frame to move between an engaging position to be directly engaged with the driving gear to transfer a rotating force of the driving motor to the driving roller when the driving roller is disposed in the first position, and a disengaging position to be spaced apart from the driving roller not to transfer the rotating force of the driving motor to the driving when the driving roller is disposed in the second position.

2. The scanning apparatus according to claim 1, further comprising:

a first sensor to detect the document disposed in the path; and a controller to control the driving motor to move the power transmitting gear between the engaging position and the disengaging position according to a determination of whether the first sensor detects the document.

3. The scanning apparatus according to claim 2, wherein the controller controls the driving motor to move the power transmitting gear between the engaging position and the disengaging position according to a determination of whether the first sensor detects the document, to prevent the power transmitting gear from colliding with the driving roller when the driving roller moves from the second position to the first position.

4. The scanning apparatus according to claim 2, further comprising:

an ADF roller to separate the document from a plurality of documents; and a second sensor to detect the plurality of documents, wherein the controller controls the driving motor to move the power transmitting gear between the engaging position and the disengaging position according to a determination of whether both of the first sensor and the second sensor detect the stack of documents.

5. A scanning apparatus, comprising:

a lower frame;

a reading unit disposed in the lower frame to read a document sheet;

an upper frame installed to pivot with respect to the lower frame to form a transfer path of the document sheet along the reading unit;

a driving roller disposed in the upper frame to feed a document to be scanned by the reading unit;

a driving gear jointed to the driving roller; and a power transmitting gear installed at the lower frame, and being movable between an engaging position to be directly engaged with the driving gear so as to supply rotational force of the driving motor to the driving roller and a disengaging position to be spaced apart from the driving gear, wherein when the upper frame is moved to the open position from the closed position, the power transfer gear is moved to the disengaging position from the engaging position to prevent the driving gear and the power transfer gear from colliding each other when the upper upper frame is moved to the closed position from the open position.

6. A scanning apparatus, including:

a lower frame;

an upper frame movable between a closed position facing the lower frame to form a document sheet transfer path therebetween and an open position;

a reading unit having a scanning glass;

a driving roller installed at the upper frame and transferring a document sheet while being in contact with the scanning glass of the reading unit while the upper frame is in the closed position;

a driving gear joined to the driving roller;

a driving motor;

a first sensor installed at the upper frame to detect the document sheet in the document sheet transfer path;

a power transmitting gear installed at the lower frame, and being movable between an engaging position to be directly engaged with the driving gear so as to supply a rotational force of the driving motor to the driving roller, and a disengaging position to be spaced apart from the driving gear; and a controlling portion to control the driving motor to move the power transfer gear to the disengaging position when the first sensor cannot detect the document sheet.

7. The scanning apparatus according to claim 6, further comprising:

an ADF roller to separate the document sheet from document sheets stacked on a document sheet tray one by one and to transfer the document sheet to a predetermined path; and a second sensor installed at the upper frame to detect the document sheets stacked on the document sheet tray, wherein when the second sensor cannot detect the document sheets, the controlling portion controls the driving motor to move the power transmitting gear to the disengaging position.

8. The scanning apparatus according to claim 6, further comprising:

a swing arm, wherein the power transmitting gear is installed at the swing arm to pivot according to a rotating direction of the driving motor, and the controlling portion controls the driving motor to rotate in a forward or reverse direction so that the swing arm pivots to move the power transmitting gear between the engaging position and the disengaging positions.

9. A method of preventing damage of gears of the scanning apparatus as claimed in claim 6, the method comprising:

when a document sheet is not detected by the first sensor, controlling the driving motor to rotate such that the power transmitting gear is moved to the disengaging position.

10. The method according to claim 9, further comprising:

when the document sheet is jammed, controlling the driving motor to rotate such that the power transmitting gear is moved to the disengaging position to remove the document sheet, and prevent the driving gear and the power transmitting gear from colliding with each other and being damaged when the upper frame moves to the closed position from the open position.

* * * * *